US005298126A

United States Patent [19]

Dahl

[11] Patent Number: 5,298,126

[45] Date of Patent: Mar. 29, 1994

[54] HEADBOX FOR A PAPER-MAKING MACHINE

[75] Inventor: Hans Dahl, Ravensburg, Fed. Rep. of Germany

[73] Assignee: Sulzer-Escher Wyss GmbH, Ravensburg, Fed. Rep. of Germany

[21] Appl. No.: 972,004

[22] Filed: Nov. 5, 1992

[30] Foreign Application Priority Data

Nov. 6, 1991 [DE] Fed. Rep. of Germany ..... 4136530

[51] Int. Cl.[5] ..... D21F 1/02

[52] U.S. Cl. ..... 162/342; 162/339; 162/340; 162/343

[58] Field of Search ..... 162/336, 339, 340, 341, 162/342, 343

[56] References Cited

U.S. PATENT DOCUMENTS

| | | | |
|---|---|---|---|
| 2,881,674 | 4/1959 | Johnson et al. | 162/340 |
| 3,165,438 | 1/1965 | Dennis et al. | 162/342 |
| 3,445,331 | 5/1969 | Lee et al. | 162/343 |
| 3,743,571 | 7/1973 | Ward | 162/342 |
| 3,888,729 | 6/1975 | Parker et al. | 162/343 |
| 4,445,975 | 5/1984 | Kurtz | 162/343 |
| 4,971,659 | 11/1990 | Takeuchi | 162/343 |
| 4,980,027 | 12/1990 | Keller | 162/343 |

FOREIGN PATENT DOCUMENTS

| | | | |
|---|---|---|---|
| 361245 | 1/1973 | U.S.S.R. | 162/343 |

*Primary Examiner*—Karen M. Hastings
*Attorney, Agent, or Firm*—Townsend and Townsend Khourie and Crew

[57] ABSTRACT

In a headbox for a paper machine a hydraulic headbox is combined with an apertured roller headbox, with at least one movable insert part (15) through which the material suspension (5) can flow being provided in the region of the flow channel (4) and/or of the nozzle channel (18) and with the flow channel (4) having a cross section through which flow takes place which broadens over at least a substantial part of its length in the direction of flow up to the moveable insert part (15).

19 Claims, 2 Drawing Sheets

HEADBOX FOR A PAPER-MAKING MACHINE

FIELD OF INVENTION

The invention relates to a headbox for a paper machine and has particular reference to a paper-making machine comprising a distributor for distributing a supplied material suspension over the web width of the paper machine, a stationary hydraulic turbulence generator and a subsequent flow channel by which the material suspension is supplied to a nozzle channel which has an outflow gap for distributing the material suspension in a predetermined thickness over the web width of the paper machine.

BACKGROUND OF INVENTION

For the generation of a qualitative high value paper web it is necessary for the material suspension which leaves the outflow slot which, for example, has a water component of over 90%, to be present in a form as homogenous as possible. Of importance in this respect is above all a uniform density of the entire paper web.

In order to avoid flock formation within the material suspension and in order to break up flock accumulations which have already arisen, two different types of headboxes are used which have become known under the terms hydraulic headboxes and apertured roller headboxes.

In a hydraulic headbox the material suspension which is supplied via a distributor is fed to a stationary turbulence generator. For example, it can be directed at an elevated speed through a plurality of outflow channels which have step-wise increasing diameters. At the steps the material suspension undergoes a sudden volume increase. The tearing apart of the flocks is brought about as a consequence of the shearing forces which occur at the steps.

Hydraulic headboxes have the advantage that, above all with long fibres and high material densities, a very homogenous consistency can be achieved of the material suspension leaving the outflow gap, they have however the disadvantage that with short fibres and low material densities inhomogeneities increase, in particular in the form of harder flocks, which leads to a granular, seedy consistency of the paper web and can impair the printing characteristics.

With apertured roller headboxes the material suspension flows through one or more rollers provided with a plurality of apertures, whereby the flocks can likewise be torn apart. Apertured roller headboxes are superior to hydraulic headboxes, particularly with short fibre lengths and slow speeds of flow and result in a softer formation. They do not, however, achieve the quality of hydraulic headboxes for longer fibres, high material densities and high speeds of flow in the headbox. Moreover, flow disturbances are generated by deflection of the flow in the apertured roller headbox.

PRINCIPAL OBJECT OF THE INVENTION

The invention is based on the object of providing a headbox of the initially named kind which makes possible in the simplest possible manner the generation of a high quality paper web over the largest possible range of use.

BRIEF DESCRIPTION OF THE INVENTION

In order to satisfy this object the invention provides a headbox of the initially named kind but characterised in that at least one movable insert part which can be flowed through by the material suspension is provided in the region of the flow channel and/or of the nozzle channel, with the flow channel having, at least over a substantial part of its length, a cross section through which flow takes place which broadens in the flow direction.

With the headbox of the invention the respective advantageous characteristics of the two kinds of headboxes are exploited. As the flow channel has a through-flow space which broadens in the flow direction, at least over a substantial part of its length, the flow speed is slowed down which leads to a considerable degree to a reduction of the undesired large turbulences within the material suspension. In this way it is possible, with the most diverse flow speeds and fibre lengths, to largely avoid web width fluctuations and to simultaneously obtain a uniform soft consistency of the material suspension.

It is of further advantage that one can not only manufacture the flow channel in a very simple and cost-favourable manner but rather that smaller requirements are also placed on the stationary hydraulic turbulence generator since a balling together of the fibre flocks is also counteracted in the flow channel as a result of the increasing cross section and through the movable insert part, for example in the form of an apertured roller or a cage drum roller through which flow can take place.

Through the guide wall of the headbox which extends obliquely downwardly in special embodiments a retardation of the flow speed and simultaneously a low turbulence is introduced into the material suspension. In this way the flocking out of the suspension can be counteracted. The flow can be guided on the whole almost in a straight line slightly downwardly inclined which prevents the deleterious deflections of the flow.

In accordance with an advantageous embodiment of the invention the flow channel is upwardly open over at least a substantial part of its length and width and communicates with an air space arranged thereabove. In this way a large free surface is present, whereby turbulence of the material suspension which is eventually too high can be effectively attenuated or damped.

For the optimisation of the damping action it is expedient for an air cushion to be present in the air space with a pressure elevated relative to the environment. In special cases. A partial vacuum can also be expedient, for example with a high damned up suspension.

The movable insert part through which flow can take place is advantageously arranged at the end of the flow channel, is cylindrical and has a diameter which is substantially the same as or larger than the vertical spacing between the floor of the flow channel and the free surface of the material suspension. In this way, a particularly long and effective calming path is ensured and with a corresponding arrangement of the movable insert part within the flow channel ensures that the total material suspension flows through the movable insert part, i.e. for example, through the apertured roller or the cage drum roller.

The arrangement of the movable insert part at the end of the flow channel furthermore ensures that an elevated air pressure in the air space disposed above the flow channel does not lead to a disturbing increase of the pressure at the outlet gap of the nozzle channel, since the movable insert part represents in this case a restrictor element.

The angular position between the longitudinal axis of the outflow channels of the turbulence generator and the floor of the flow channel or the free surface of the material suspension in the flow channel is advantageously determined in dependence on the flow speed in the region of the floor and/or of the free surface of the material suspension. This can be brought about in a simple manner in that the outflow channels of the turbulence generator are so arranged, depending on the requirement, that they open in a straight line obliquely upwardly or obliquely downwardly into the flow channel.

If the angle between the longitudinal axes of the outflow channels of the stationary turbulence generator and the floor of the flow channel is selected to be greater than the angle between the longitudinal axes of the outflow channels and the free surface of the material suspension in the flow channel, then displacements in the flow profile as a result of retardations of the upper stream lines as a consequence of an upwardly opposed direction of rotation of the movable insert part through which flow can take place an be compensated.

If the angle between the longitudinal axes of the outflow channels and the floor of the flow channel are in contrast selected to be smaller than the angle between the longitudinal axes of the outflow channels and the free surface of the material suspension in the flow channel then shifts in the flow profile as a result of retardations of the lower flow filaments as a consequence of the greater wall friction along the base of the channel can be compensated.

In an arrangement in which the angle between the longitudinal axes of the outflow channels and the floor of the flow channel is the same as the angle between the longitudinal axes of the outflow channels and the free surface of the material suspension in the flow channel, the stationary turbulence generator is arranged in front of the flow channel in such a way that the material suspension flows on a largely straight path from the distributor to the nozzle channel. In this way a minimum dwell time of the material suspension in the flow channel is achieved and undesired return flocking is counteracted.

The floor of the flow channel advantageously includes an angle of 5° to 15° with the horizontal, whereby the longitudinal axes of the outflow channels of the turbulence generator can include an angle of 2° to 10° with the horizontal. The flow channel and the outflow channels of the stationary turbulence generator are located with such an arrangement in an oblique position so that when the paper machine is stationary they can be emptied in simple manner.

Further advantageous embodiments of the invention are evident from the subordinate claims.

BRIEF LISTING OF THE DRAWINGS

The invention will subsequently be explained in more detail with reference to the drawing in which are shown:

FIG. 1 a schematic side view of a headbox in accordance with the invention,

FIG. 2 a schematic plan view of the headbox of FIG. 1, and

FIGS. 3 to 6 schematically illustrated variants of headboxes in accordance with the invention.

DESCRIPTION OF PREFERRED EMBODIMENTS

Figure 1:
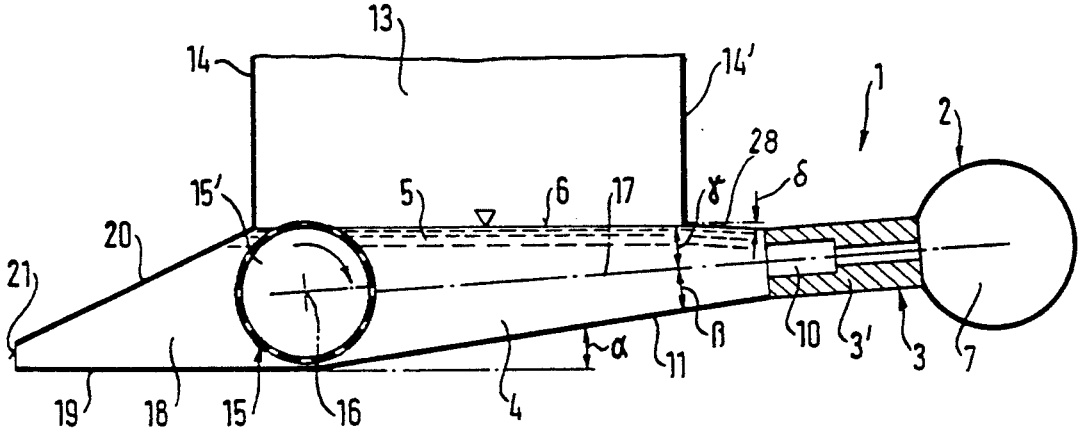
Figure 2:
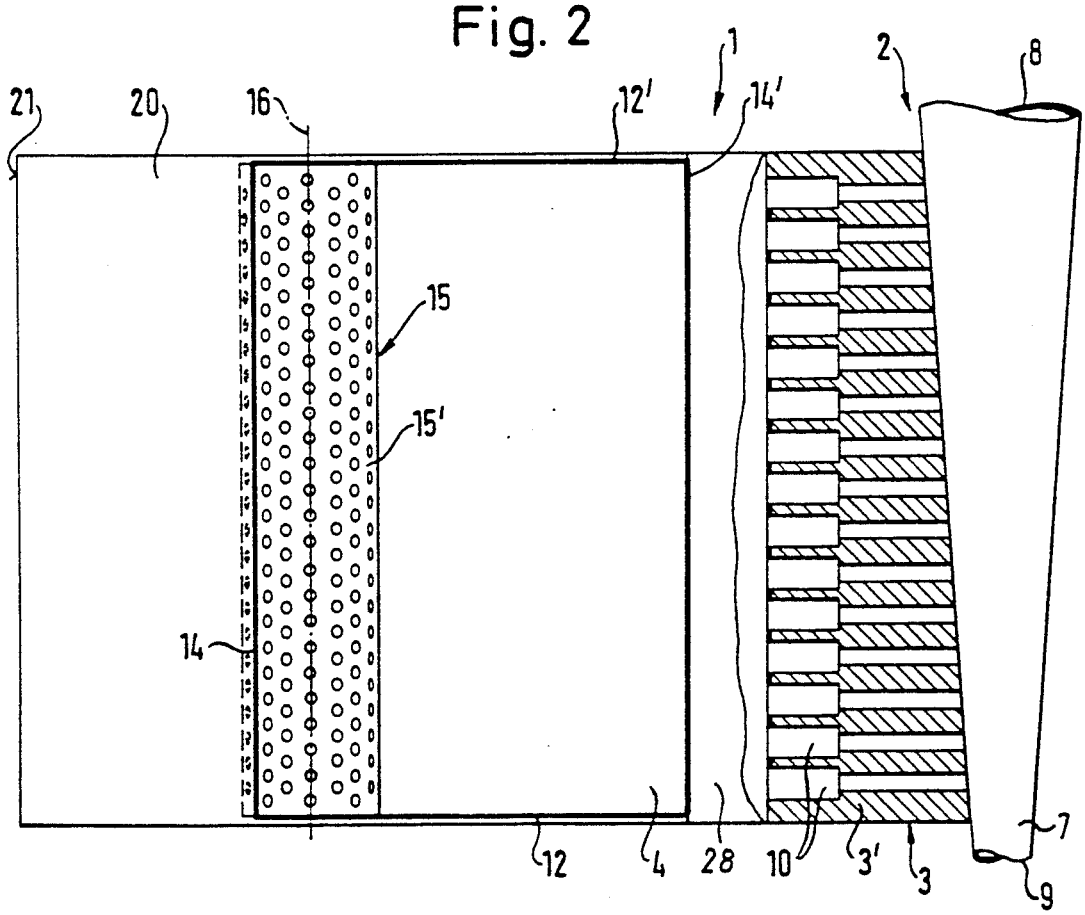

From FIGS. 1 and 2 a headbox 1 can be seen with a distributor 2, a stationary hydraulic turbulence generator 3 in form of a stepped diffuser block 3' and also a flow channel 4 in which a material suspension 5 is located up to the level of its free surface or boundary surface 6.

The distributor 2 serves for the supply and distribution of the material suspension 5 over the entire width of the paper machine and has for this purpose a transversely directed supply channel 7 with a circular cross section the diameter of which is greater at its supply end 8 than at its outflow end 9.

The stepped diffuser block 3' joins the distributor 2 or the supply channel 7 at the side and has a parallel row of outflow channels 10 which extend over the entire width of the flow channel 4 (FIG. 2) The outflow channels 10 flow into the flow channel 4. The outflow channels 10 are cylindrical bores of stepped diameter, with the section adjacent the flow channel having a larger diameter than the section adjacent the supply channel 7.

The flow channel 4 is a channel with a flat floor 11 and two vertical parallel side walls 12, 12'. The cross section is thus U-shaped, with the side walls 12, 12' having a spacing from one another which corresponds essentially to the width of the paper web to be formed. Towards the top the flow channel 4 is at least partially open so that the material suspension forms a horizontal free surface 6. An air space 13 adjoins this free surface 6 at the top and is indicated by lateral boundary walls 14, 14' in the FIGS. 1 and 2. This air space 13 is normally closed so that an air cushion, for example with an elevated air pressure can be built up within the air space which presses onto the free surface 6 of the material suspension.

The floor 11 of the flow channel 4 drops away here continuously in the flow direction and includes an angle $\alpha$ of approximately 8° with the horizontal. In this way the depth of the material suspension flow within the flow channel 4 increases continually from the entry side facing the step diffuser block 3' to the oppositely disposed outlet side.

In accordance with FIG. 1 the flow channel 4 adjoins in a straight line the outflow channels 10 of the stepped diffuser block 3' that is to say the angle $\beta$ between the longitudinal axes of the outflow channels 10 and the floor 11 of the flow channel 4 is of the same size as the angle $\gamma$ between the longitudinal axes of the outflow channels 10 and the free surface 6 of the material suspension flow in the flow channel 4. In this way, a symmetrical flow forms within the flow channel 4 with a plane of symmetry lying at the central height contour line 17. In the embodiment shown in FIG. 1 both the angle $\beta$ and also the angle $\gamma$ amount to approximately 3°.

The boundary wall 14' of the airspace 13 is somewhat spaced in the flow direction from the outlet end of the stepped diffusor block, with the upper side of the flow channel 4 being covered over in this intermediate region by means of an upper cover wall 28. The cover wall 28 is inclined at an angle $\delta$ of 0° to 5° to the horizontal whereby the rising of air bubbles into the airspace 13 is aided.

In deviation from FIG. 1 it is, however, also possible for the stepped diffuser block 3' not to be aligned in a straight line but rather to arrange it at a specific angle to the flow channel 4 in order to compensate for different flow speeds of the material suspension in the proximity of the floor or in the proximity of the free surface 6 of the flow channel 4. If the stepped diffuser block 3' is arranged relative to the flow channel 4 such that the longitudinal axes of the outflow channels 10 include an angle $\gamma$ of only 0° to 2° with the free surface 6 of the material suspension (whereby the angle $\beta$ adopts a value between 4° and 6° ) then the material suspension flow which emerges from the outflow channels 10 is directed more upwardly so that the upper flow filaments within the flow channel 4 are exposed to a higher flow pressure. In this way retardations of the upper flow filaments as a result of an opposed direction of rotation of a movable insert part 15 in the form of an apertured roller 15', through which flow takes place and which is arranged in the area of the outlet side of the flow channel 4, can be compensated.

Vice versa it is also possible to make the angle $\beta$ smaller than the angle $\gamma$, i.e. in the present example only 0° to 2° , whereby the material suspension flow emerging from the outflow channels 10 is directed approximately parallel to the floor 11 of the flow channel 4 and a retardation of the lower flow filaments as a result of the greater wall friction along the floor 11 can be compensated for.

For the compensation of errors in the speed profile the individual rows of outflow channels can be equipped with different flow cross sections which generate differential pressure drops.

The apertured roller 15' arranged at the downstream end of the flow channel 4 is rotatable about a transversely directed axis of rotation 16 in the clockwise sense. The direction of rotation of the apertured roller 15' is thus opposed at its highest point to the direction of flow of the material suspension. Furthermore, the apertured roller 15' is arranged in such a way and has such a diameter that the total material suspension volume flow must pass through the apertured roller 15'.

The flow channel 4 is followed in the flow direction by a nozzle channel 18 which is bounded towards the bottom by a horizontal floor 19 and towards the top by a downwardly inclined lip part 20, so that the nozzle channel 18 has a narrowing cross section. Sidewalls are also provided.

The material suspension 5 can emerge via an outflow gap 21 arranged at the end of the nozzle channel 18 and passes from there to a non-illustrated sieve (or papermaking felt or wire) which is guided around a likewise non-illustrated deflection roller with a horizontal axle of rotation.

The height of the outflow gap 21 can be changed by displacement of the lip part 20 in the vertical direction. In order to be able to maintain an ideal geometry and technical flow association of the apertured roller 15' to the lip part 20 with such an adjustment, the apertured roller 15' is displaceably mounted in the horizontal and/or vertical direction. Both displacement movements, i.e. that of the lip part 20 and that of the apertured roller 15' can be synchronised with one another.

In the outflow channels 10 of the step diffuser block 3' a relatively high flow speed prevails, with the material suspension 5 undergoing a volume increase through the sudden broadening at the steps of the outflow channels 10, which brings about a tearing apart of large agglomerates and fibre flocks. Within the flow channel 4 the material suspension flows essentially further in a straight line and is increasingly slowed down as a result of the continuous broadening of the flow channel 4 in the vertical direction, so that an effective calming occurs. Furthermore, as a result of the straight-line flow between the step diffuser block 3' and the apertured roller 15', the dwell time of the material suspension within the flow channel 4 is only short, whereby return flocking, i.e. the reformation of agglomerates, is avoided. After passing the apertured roller with which a particularly soft formation is obtained the material suspension flows through the outflow gap 21 onto the non-illustrated sieve, where a uniform and homogenous paper web distributed over the entire sieve width is formed from the material suspension.

It is straightforwardly possible to make the entire flow channel open at the top between the step diffuser block 3' and the apertured roller 15' so that a large free surface 6 is present which is acted on by the air cushion provided in the air space 13 to damp undesired turbulence within the material suspension. In this way no walls are present towards the top on which deposits can form. It is, however, likewise possible to form the flow channel 4 as a partially or fully upwardly closed continuously broadening shaft.

Figure 3:
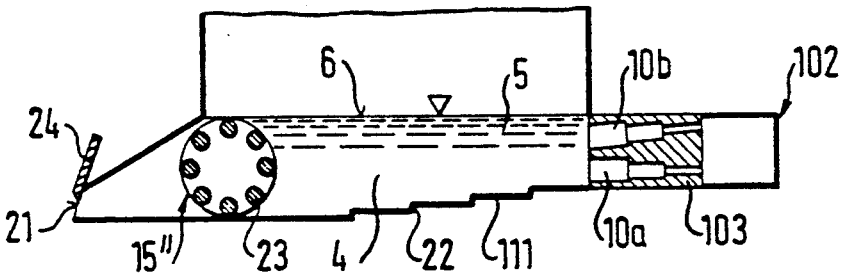

From FIG. 3 there can be seen an embodiment of a headbox in accordance with the invention in which the distributor 102 is rectangular in cross section. The stepped diffuser block 103 has two rows of stepped diffusers lying above one another, with the outflow channels **10*a* of the lower row being horizontally aligned and with the outflow channels 10*b* of the upper row extending obliquely downwardly in the flow direction. The outflow channels 10*a*, 10*b* of the two rows thus extend convergently to one another, whereby a desired flow profile within the flow channel 4** can be achieved.

The broadening of the flow cross section of the flow channel 4 takes place here through step projections 22 of the floor 111 which are so arranged relative to the free surface 6 that the floor 111 drops away in the flow direction in step-like manner.

The movable insert part which is provided at the end of the flow channel 4 comprises a cage drum roller 15'' the peripheral surface of which is formed by horizontal bars 23 arranged transverse to the flow direction and spaced from one another and is intended to bring about a softer formation of the material suspension in a similar manner to an apertured roller.

The material suspension 5 flows through the intermediate spaces between the bars 23 from the flow channel 4 to the outflow gap 21 the height of which is adjustable via a slider 24.

Figure 4:
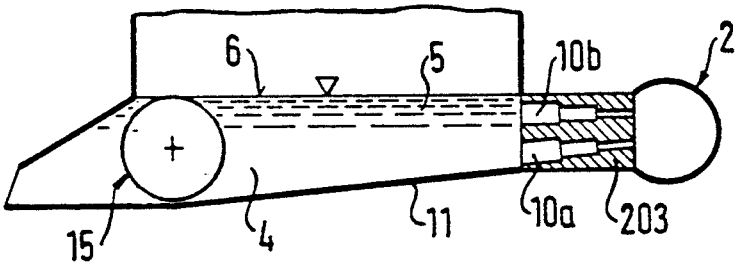

FIG. 4 shows a stepped diffuser block 203 with two rows of step diffusers arranged above one another, with the outflow channels **10*a* of the lower row and the outflow channels 10*b* of the upper row extending divergently to one another. The outflow channels 10*a* of the lower row thereby extend essentially in the same direction as the subsequent part of the continuously dropping away floor 11, while the outflow channels 10*b*** of the upper row extend horizontally.

Figure 5:
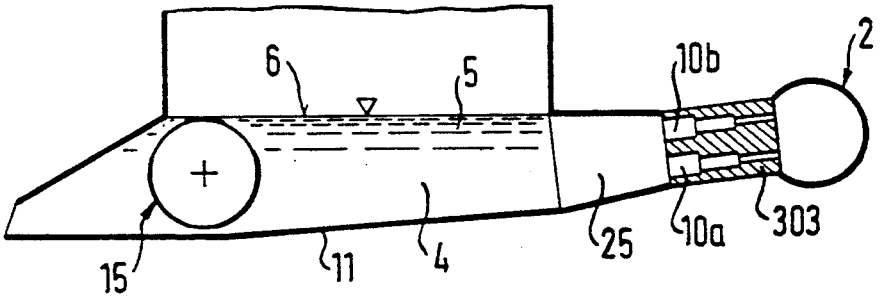
Figure 6:
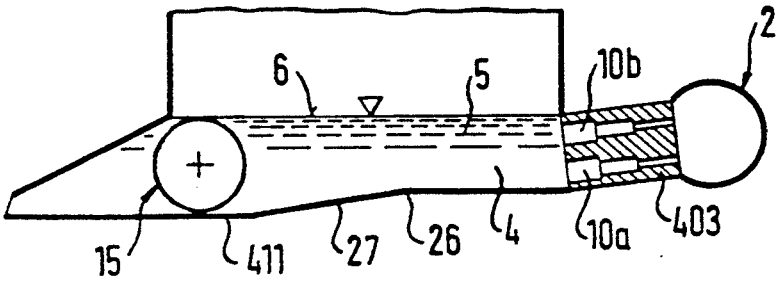

From FIG. 5 there can be seen a stepped diffuser block 303 with two parallel rows of outflow channels **10*a* and 10*b* arranged above one another. From the step diffuser block 303 the material suspension flows into a closed channel section 25 the cross section of which increases continuously in the flow direction. This broadening channel section 25 already contributes to the calming and slowing down of the material suspension flow before it passes into the flow channel 4 having a free surface 6. The outflow channels 10***a*, 10*b* and the channel section 25 are aligned at a specific angle to the horizontal, and drop away in the flow direction. In this way, a simple cleaning and emptying of the step diffuser block 303 is made possible. In the headbox shown in FIG. 6 the flow channel 4 has a kinked floor 411 with a kinked position 26 relative to the free surface 6. This kinked position 26 is formed in such a way that the floor 411 first extends horizontally following the stepped diffuser block 403 and then passes into a region 27 which continuously drops away obliquely. Shortly before or beneath the movable insert part 15 through which flow can take place the floor 411 again extends horizontally.

As can be seen in FIGS. 1, and 3–6, the flow channel 4 has a flow cross section which broadens over a substantial part of its length and up to the moveable inset part 15.

I claim:

1. A headbox for a paper machine for producing a paper web of a desired width, said headbox comprising a distributor, a stationary hydraulic turbulence generator following said distributor, a flow channel following said turbulence generator and having an inflow end, a floor, an outflow end and a length, at least one movable apertured roller positioned at said outflow end of said flow channel and a nozzle channel following said movable apertured roller, wherein said stationary hydraulic turbulence generator is a stepped diffuser block with a plurality of outflow channels each having a flow direction and a diameter which enlarges stepwise in said flow direction, and wherein said flow channel has, at least over a substantial part of said length, a cross section through which flow takes place and which broadens from said inflow end towards said outflow end up to said roller.

2. Headbox in accordance with claim 1, wherein said flow channel is upwardly open at least over a substantial part of its length and communicates with an air space arranged thereabove.

3. Headbox in accordance with claim 2, wherein said headbox is structured and arranged so that an air cushion with a pressure elevated relative to the environment is provided within said air space.

4. Headbox in accordance with claim 2, wherein said headbox is structured and arranged so that an air cushion with a pressure reduced relative to the environment is provided within said air space.

5. Headbox in accordance with claim 1, wherein said material suspension has a free surface and wherein said apertured roller has a direction of rotation such that a direction of surface movement of said aperture roller at said free surface of said material suspension is opposite to a direction of flow of said material suspension at said free surface.

6. Headbox in accordance with claim 1, wherein said floor of said flow channel includes an angle of 5° to 15° with a horizontal direction and said flow directions of said outflow channels of said turbulence generator include an angle of 2° to 10° with said horizontal direction.

7. Headbox in accordance with claim 1, wherein said stepped diffuser block comprises at least two rows of stepped diffusers which lie substantially above one another, with outflow channels in each row extending respectively parallel to one another.

8. Headbox in accordance with claim 7, wherein at least two rows of stepped diffusers of said diffuser block have outflow channels extending convergently to one another.

9. Headbox in accordance with claim 7, wherein at least two rows of stepped diffusers of said stepped diffuser block have outflow channels which extend divergently to one another, with the direction of the outflow channels of a highest row extending approximately in said horizontal direction and with said flow directions of the outflow channels of a lowermost row being approximately the same as a direction of said floor of said flow channel.

10. Headbox in accordance with claim 1, wherein said axis of rotation of the cylindrical movable insert part is arranged at a level corresponding to a central height contour line of said flow channel through which flow takes place.

11. Headbox in accordance with claim 1, wherein a region of said flow channel is so shaped that the broadening of the flow cross section takes place continuously.

12. Headbox in accordance with claim 1, wherein a region of said flow channel is so shaped that the broadening of the flow cross section takes place discontinuously through a kinked floor.

13. Headbox in accordance with claim 1, wherein a region of said flow channel is so shaped that the broadening of the flow cross section takes place discontinuously through step changes in said floor.

14. Headbox in accordance with claim 1 wherein an angle is formed between said flow directions in said outflow channels and said floor of said flow channel and is substantially the same size as an angle formed between said flow directions in said outflow channels and a free surface of said material suspension in said flow channel.

15. Headbox in accordance with claim 1 wherein an angle is formed between said flow directions in said outflow channels and said floor of said flow channel and is smaller than an angle formed between said flow directions in said outflow channels and a free surface of said material suspension in said flow channel.

16. A headbox for a paper machine for producing a paper web of a desired width, said headbox comprising a distributor, a stationary hydraulic turbulence generator following said distributor, a flow channel following said turbulence generator and having an inflow end, a floor, an outflow end and a length and being open at a top side with said material suspension having a free surface within said channel, at least one movable insert part positioned at said outflow end of said flow channel, said movable insert part being cylindrical, having an axis of rotation, and a diameter which is substantially the same as or larger than a vertical spacing between said floor of said flow channel and a free surface of said material suspension flowing through said flow channel, and a nozzle channel following said movable insert, wherein said stationary hydraulic turbulence generator is a stepped diffuser block with a plurality of outflow channels each having a flow direction and a diameter which enlarges stepwise in said flow direction, and wherein said flow channel has, at least over a substantial part of said length, a cross section through which flow takes place and which broadens from said inflow end towards said outflow up to said movable insert end.

17. Headbox in accordance with claim 16, wherein said movable insert part is a cage drum roller.

18. A headbox for a paper machine for producing a paper web of a desired width, said headbox comprising a distributor, a stationary hydraulic turbulence generator following said distributor, a flow channel following said turbulence generator and having an inflow end, a floor, an outflow end and a length, at least one movable apertured roller positioned at said outflow end of said flow channel and a nozzle channel following said movable apertured roller, wherein said stationary hydraulic turbulence generator is a stepped diffuser block with a plurality of outflow channels each having a flow direction and a diameter which enlarges stepwise in said flow direction, wherein said flow channel has, at least over a substantial part of said length, a cross section through which flow takes place and which broadens from said inflow end towards said outflow end up to said roller, and wherein said headbox is structured so that said material suspension flows through said flow channel in a direction at least substantially the same as said flow directions through said outflow channels of said turbulence generator.

19. A headbox for a paper machine for producing a paper web of a desired width, said headbox comprising a distributor, a stationary hydraulic turbulence generator following said distributor, a flow channel following said turbulence generator and having an inflow end, a floor, an outflow end and a length and being open at a top side with said material suspension having a free surface within said channel, at least one movable insert part positioned at said outflow end of said flow channel, said movable insert part being cylindrical having an axis of rotation, and a diameter which is substantially the same as or larger than a vertical spacing between said floor of said flow channel and a free surface of said material suspension flowing through said flow channel, and a nozzle channel following said movable insert, wherein said stationary hydraulic turbulence generator is a stepped diffuser block with a plurality of outflow channels each having a flow direction and a diameter which enlarges stepwise in said flow direction, wherein said flow channel has, at least over a substantial part of said length, a cross section through which flow takes place and which broadens from said inflow end towards said outflow end up to said movable insert, and wherein said headbox is structured so that said material suspension flows through said flow channel in a direction at least substantially the same as said flow directions through said outflow channels of said turbulence generator.

* * * * *